US009797157B2

(12) United States Patent
Lovley, II

(10) Patent No.: US 9,797,157 B2
(45) Date of Patent: Oct. 24, 2017

(54) CANOPY WITH DETACHABLE AWNING

(71) Applicant: ShelterLogic Corp., Watertown, CT (US)

(72) Inventor: Jack B. Lovley, II, Lake Forest, CA (US)

(73) Assignee: ShelterLogic Corp., Watertown, CT (US)

( * ) Notice: Subject to any disclaimer, the term of this patent is extended or adjusted under 35 U.S.C. 154(b) by 0 days.

(21) Appl. No.: 14/607,459

(22) Filed: Jan. 28, 2015

(65) Prior Publication Data

US 2015/0252587 A1 Sep. 10, 2015

Related U.S. Application Data

(60) Provisional application No. 61/947,893, filed on Mar. 4, 2014.

(51) Int. Cl.

| | |
|---|---|
| ***E04H 15/58*** | (2006.01) |
| ***E04H 15/00*** | (2006.01) |
| *E04H 15/64* | (2006.01) |

(52) U.S. Cl.
CPC ..... *E04H 15/58* (2013.01); *E04H 15/00* (2013.01); *E04H 15/64* (2013.01)

(58) Field of Classification Search
CPC ..... E04H 15/58; E04H 15/54
USPC ..... 135/117, 120.3
See application file for complete search history.

(56) References Cited

U.S. PATENT DOCUMENTS

| | | | |
|---|---|---|---|
| 33,398 | A | 10/1861 | Miller |
| 292,941 | A | 2/1884 | Nunnelley |
| 574,235 | A | 12/1896 | Bennitt |
| 900,572 | A | 10/1908 | Morton |
| 914,774 | A | 3/1909 | Zimmerman |
| 1,024,176 | A | 4/1912 | Boyens |
| 1,075,372 | A | 10/1913 | Overshiner |
| 1,238,646 | A | 8/1917 | Dennis |
| 1,256,902 | A | 2/1918 | Howe |
| 1,334,048 | A | 3/1920 | Powers |
| 1,341,689 | A | 6/1920 | Walmsley |
| 1,429,043 | A | 9/1922 | Martin |
| 1,443,921 | A | 1/1923 | Mackenzie |

(Continued)

FOREIGN PATENT DOCUMENTS

| | | |
|---|---|---|
| AU | A 15170/92 | 12/1993 |
| CH | 635 393 | 3/1983 |

(Continued)

*Primary Examiner* — David R Dunn
*Assistant Examiner* — Danielle Jackson
(74) *Attorney, Agent, or Firm* — Carmody Torrance Sandak & Hennessey, LLP

(57) ABSTRACT

A tent, such as a collapsible canopy, having removable awning structures. In some embodiments, the awning structure includes a detachable connection member, an awning tube coupled to the connection member and an awning fabric or other suitable awning body. The awning cloth can be fixed on the awning tube, such as extending between a pair of awning tubes. When the intensity or direction of the outdoor environment light/precipitation changes, the removable awning structures may be deployed as desired to increase or adjust the shade area according in the desired direction to flexibly meet shade or storm requirements.

11 Claims, 10 Drawing Sheets

(56) References Cited

U.S. PATENT DOCUMENTS 1,575,902 A * 3/1926 Dial ..... E04H 15/50 135/117
1,593,431 A * 7/1926 Buie ..... E04H 15/48 135/117
1,605,679 A 11/1926 McGrail
1,639,074 A 8/1927 Blackwood
1,666,757 A 4/1928 Snyder
1,763,455 A 6/1930 Bruijn
1,789,090 A 1/1931 Wawrunek
1,846,011 A * 2/1932 Adams ..... E04H 15/48 135/117
1,915,504 A 6/1933 Stokby
2,001,252 A 5/1935 Johnson
2,070,484 A 2/1937 Jones
2,137,427 A 11/1938 Thomson
2,151,908 A * 3/1939 Gottlieb ..... E04B 1/3441 135/117
2,166,832 A 7/1939 Wenker
2,243,984 A 6/1941 Singewald
2,265,479 A * 12/1941 Dwight ..... E04H 15/58 135/140
2,429,763 A 10/1947 Lindabury
2,490,367 A 12/1949 Maddocks
2,545,968 A 3/1951 Newstead
2,561,886 A 7/1951 Rikelman
2,571,382 A 10/1951 Raven
2,658,562 A 11/1953 Androsiglio
D171,176 S 12/1953 Yellen
2,689,603 A 9/1954 Smith
2,712,349 A 7/1955 Voir
2,719,688 A 10/1955 Seifert
2,729,276 A 1/1956 Volney
2,747,653 A 5/1956 Obradovich
2,752,929 A 7/1956 Berger
D180,210 S 4/1957 Uretsky
2,819,776 A 1/1958 Balsam
2,849,249 A 8/1958 Fridolph
2,926,724 A 3/1960 Rittenberg
2,932,047 A 4/1960 Johnston
2,989,968 A 6/1961 Gunter
3,007,735 A 11/1961 Cohn
3,034,523 A 5/1962 De Shano
3,085,586 A 4/1963 McDonough
3,092,224 A 6/1963 O'Neil
3,151,909 A 10/1964 Gerdetz
3,179,465 A 4/1965 Roberts
3,214,217 A 10/1965 Jente
3,243,230 A 3/1966 Otto
3,307,758 A 3/1967 Platt
3,309,134 A 3/1967 Roberts
3,333,595 A 8/1967 Bannister
3,339,566 A 9/1967 Bowden
3,371,671 A 3/1968 Kirkham
3,404,915 A 10/1968 Filho
3,450,432 A 6/1969 Minsker
3,544,157 A 12/1970 Muller
3,580,633 A 5/1971 Du Priest
3,621,857 A * 11/1971 May et al. ..... E04H 15/00 135/117
3,637,086 A 1/1972 Klein
3,879,086 A 4/1975 Moceri
3,918,109 A 11/1975 Barraclough
3,931,918 A 1/1976 Smith et al.
3,935,874 A 2/1976 Cohen
3,947,903 A 4/1976 Menke
4,029,279 A 6/1977 Nakatani
4,030,748 A 6/1977 Brock
4,047,752 A 9/1977 Rohr
4,063,318 A 12/1977 Nicholson
4,082,102 A 4/1978 Heuer
4,123,095 A 10/1978 Stehlin
4,174,900 A 11/1979 Ina
4,201,416 A 5/1980 Vanderminden
4,248,255 A 2/1981 Arrowsmith
4,251,106 A 2/1981 Gilbert
D261,332 S 10/1981 Rohr
4,293,162 A 10/1981 Pap et al.
4,295,481 A 10/1981 Gee
4,300,798 A 11/1981 Musgrove et al.
4,445,590 A 5/1984 Ihrman
4,487,345 A 12/1984 Pierce et al.
4,497,092 A 2/1985 Hoshino
4,528,998 A 7/1985 Gamm
4,530,451 A 7/1985 Hamilton
4,536,026 A 8/1985 Cornell
4,573,717 A 3/1986 Peacock
4,596,484 A 6/1986 Nakatani
4,635,667 A 1/1987 Harn
4,639,036 A 1/1987 Nichols
4,639,958 A 2/1987 Lerner
4,641,676 A 2/1987 Lynch
4,641,883 A 2/1987 Kato
D289,473 S 4/1987 Myers
4,687,248 A 8/1987 Ross et al.
4,687,249 A 8/1987 Mills
4,736,825 A 4/1988 Belfi
4,744,690 A 5/1988 Hsieh
4,761,092 A 8/1988 Nakatani
4,773,574 A 9/1988 Burgard
4,779,635 A 10/1988 Lynch
4,795,068 A 1/1989 Blean
4,796,734 A 1/1989 Distasic
4,809,724 A 3/1989 Fuser
4,810,029 A 3/1989 Kaladis et al.
4,824,171 A 4/1989 Hollingsworth
4,858,990 A 8/1989 Combs-Rose et al.
4,865,381 A 9/1989 Van Rogue
4,870,984 A 10/1989 Roth
4,885,812 A 12/1989 Linder
4,889,383 A 12/1989 Jones
4,915,120 A 4/1990 Ziolkowski
4,924,896 A 5/1990 Carter
4,932,622 A 6/1990 Hayakawa
4,949,929 A 8/1990 Kesselman et al.
D310,605 S 9/1990 Kwon
4,971,089 A 11/1990 Braman
4,972,981 A 11/1990 Gex
5,000,210 A 3/1991 Worthington, Jr.
5,013,085 A 5/1991 Craig
5,022,420 A 6/1991 Brim
5,035,253 A * 7/1991 Bortles ..... E04H 15/50 135/117
5,042,874 A 8/1991 Williams
5,054,848 A 10/1991 Liu
5,080,432 A 1/1992 Connell
5,096,257 A 3/1992 Clark
5,102,190 A 4/1992 Akin et al.
5,135,281 A 8/1992 Pappalardo
5,139,308 A 8/1992 Ziman
5,154,449 A 10/1992 Suei-Long
5,154,473 A 10/1992 Joranco
5,203,363 A 4/1993 Kidwell et al.
5,205,308 A 4/1993 Kendall et al.
5,209,381 A 5/1993 Jay
5,240,020 A 8/1993 Byers
5,244,001 A 9/1993 Lynch
5,244,250 A 9/1993 Nordmeyer
D339,937 S 10/1993 Ryan
5,289,958 A 3/1994 Jay
5,299,337 A 4/1994 Venza
5,303,975 A 4/1994 Asato
5,320,405 A 6/1994 Foster et al.
5,350,215 A 9/1994 DeMars
5,362,130 A 11/1994 Hoffman
5,387,048 A 2/1995 Kuo
5,388,821 A 2/1995 Blackburn
5,395,157 A 3/1995 Rollo et al.
5,421,356 A 6/1995 Lynch
D360,535 S 7/1995 Sjoberg
5,433,502 A 7/1995 Condorodis et al.
5,433,552 A 7/1995 Thyu
5,441,067 A 8/1995 James et al.
5,449,014 A 9/1995 Yan-ho

(56) References Cited

U.S. PATENT DOCUMENTS 5,485,863 A 1/1996 Carter
5,490,533 A 2/1996 Carter
5,511,572 A 4/1996 Carter
5,516,193 A 5/1996 Simpson
5,533,654 A 7/1996 Holty et al.
5,538,318 A 7/1996 MacLean
5,538,319 A 7/1996 DiMurro
5,544,793 A 8/1996 Harrop
5,547,246 A 8/1996 Lambert
5,551,110 A 9/1996 Armstrong et al.
5,551,669 A 9/1996 Reinklou
5,564,452 A 10/1996 Kitchen
5,579,797 A 12/1996 Rogers
5,582,458 A 12/1996 Wildt
5,593,205 A 1/1997 Vanderminden, Sr. et al.
5,593,239 A 1/1997 Sallee
5,597,101 A 1/1997 Barber et al.
5,626,271 A 5/1997 Messey et al.
5,632,292 A 5/1997 Carter
5,634,483 A 6/1997 Gwin
5,638,851 A * 6/1997 Baldwin ..... E04H 15/36 135/116
D380,306 S 7/1997 Lin
D382,126 S 8/1997 Lee
D382,414 S 8/1997 Lee
5,695,100 A 12/1997 O'Brien
5,695,296 A 12/1997 Miura
5,718,473 A 2/1998 Lynch, Jr.
5,722,717 A 3/1998 Rettenberger
5,735,570 A 4/1998 Tseng
5,794,640 A 8/1998 Jang
5,797,650 A 8/1998 Gonzalez, Jr. et al.
5,813,425 A 9/1998 Carter
5,819,999 A 10/1998 Tennant
5,833,310 A 11/1998 Labelle
5,873,625 A 2/1999 Uchtman
5,921,258 A 7/1999 Francois
5,934,301 A 8/1999 Carter
5,934,631 A 8/1999 Becker
5,951,103 A 9/1999 Barnhill
5,961,178 A 10/1999 Hodson
5,967,601 A 10/1999 Gillins
5,975,626 A 11/1999 Aycock
5,984,406 A 11/1999 Lee
6,000,175 A 12/1999 Gale et al.
6,006,477 A 12/1999 Ko
6,035,877 A 3/2000 Losi, Jr. et al.
6,036,262 A 3/2000 Shahid
6,045,177 A 4/2000 Grace
6,070,604 A 6/2000 Carter
6,082,813 A 7/2000 Chen
6,089,247 A 7/2000 Price
6,095,172 A 8/2000 Trapp et al.
6,095,596 A 8/2000 Chen
6,102,479 A 8/2000 Wallace
6,112,757 A 9/2000 Tseng
6,129,102 A 10/2000 Carter
6,131,593 A 10/2000 Greene et al.
6,142,699 A 11/2000 Pao
6,148,835 A 11/2000 Rhee
6,152,156 A 11/2000 Tung
6,164,726 A 12/2000 Reeves et al.
6,179,514 B1 1/2001 Cheng
6,206,463 B1 3/2001 Whigham
6,230,729 B1 5/2001 Carter
6,241,311 B1 6/2001 Zheng
6,250,712 B1 6/2001 Livington et al.
6,263,895 B1 7/2001 Bang
6,264,271 B1 7/2001 Munn et al.
6,276,382 B1 8/2001 Bindschatel et al.
6,283,136 B1 9/2001 Chen
6,296,002 B1 10/2001 Tashchyan
6,328,131 B1 12/2001 Backus
6,354,044 B1 3/2002 Lagace, Jr.
6,363,956 B2 4/2002 Carter
6,371,553 B1 4/2002 Tang
6,405,742 B1 6/2002 Driscoll
6,412,507 B1 7/2002 Carter
6,418,949 B1 7/2002 Lin et al.
6,450,569 B1 9/2002 Liu
6,471,289 B2 10/2002 Aguilar
6,478,039 B2 * 11/2002 Suh ..... E04H 15/50 135/120.3
6,508,262 B1 1/2003 Takayama
6,516,821 B1 2/2003 Uemura
6,520,196 B2 2/2003 Carter
6,520,574 B1 2/2003 Huang
6,536,723 B1 3/2003 Nakatani
6,547,324 B1 4/2003 Ammann, Jr.
6,551,226 B1 4/2003 Webber et al.
6,575,656 B2 6/2003 Suh
6,591,849 B1 7/2003 Swetish et al.
6,655,736 B1 12/2003 Arenas
6,672,631 B1 1/2004 Weinhold
6,676,092 B2 1/2004 Tsai
D487,297 S 3/2004 Tyler et al.
6,698,827 B2 3/2004 Le Gette et al.
6,712,083 B2 3/2004 Carter
6,718,995 B2 * 4/2004 Dotterweich ..... E04H 15/50 135/117
D494,769 S 8/2004 Vigneaud
6,779,538 B2 8/2004 Morgante et al.
6,789,557 B1 9/2004 Wahl, Jr.
6,823,883 B1 11/2004 Sears
6,824,210 B2 11/2004 Zheng
6,837,642 B1 1/2005 Lin
6,845,780 B2 1/2005 Bishirjian
6,899,383 B2 5/2005 Hwang
6,908,249 B2 6/2005 Tomm
6,913,231 B2 7/2005 Speggiorin
6,926,355 B2 8/2005 Le Gette et al.
6,929,017 B2 8/2005 Byun
6,979,056 B1 12/2005 Goldszer
6,981,510 B2 1/2006 Carter
7,040,832 B2 5/2006 Hsieh
7,044,145 B2 5/2006 Bouchard
7,044,146 B2 5/2006 Losi, Jr.
7,048,333 B2 5/2006 Martinez
D522,605 S 6/2006 Bishirjian
7,066,676 B2 6/2006 Tsai
7,097,380 B2 8/2006 Lee
7,118,172 B1 10/2006 Pattison-Sheets
7,168,759 B2 1/2007 Gallegos Geier
7,172,532 B2 2/2007 Baker
7,198,324 B2 4/2007 Le Gette et al.
7,231,954 B2 6/2007 Green
7,240,685 B2 * 7/2007 Seo ..... E04H 15/50 135/120.3
7,240,687 B2 7/2007 Carter
7,243,990 B1 7/2007 Wahl
7,252,108 B2 8/2007 Carter
7,261,263 B2 8/2007 Baker et al.
7,293,934 B1 11/2007 Huang
7,296,584 B2 11/2007 Goldwitz
7,299,812 B2 * 11/2007 Carter ..... E04H 15/58 135/117
7,299,813 B2 11/2007 Ochi
7,302,745 B2 12/2007 Stahle
7,302,957 B2 12/2007 Ross
7,311,355 B2 12/2007 Fargason, III
7,316,450 B2 1/2008 Ayers et al.
7,350,532 B2 4/2008 Wu
7,373,708 B2 5/2008 Stahle et al.
7,374,238 B2 5/2008 Lingwall
7,380,563 B2 6/2008 Seo
7,395,830 B2 7/2008 Seo
7,396,073 B2 7/2008 Zheng
7,409,963 B2 8/2008 Mallookis et al.
7,422,009 B2 9/2008 Rummel et al.
7,422,026 B2 9/2008 Kim
7,427,101 B1 9/2008 Zernov
7,428,908 B2 9/2008 Seo
7,431,389 B2 10/2008 Reeb et al.
7,481,236 B2 1/2009 Carter

(56) References Cited

U.S. PATENT DOCUMENTS

| | | | | |
|---|---|---|---|---|
| 7,494,296 | B2 | 2/2009 | Stahle | |
| RE40,657 | E | 3/2009 | Suh | |
| 7,527,331 | B2 | 5/2009 | Fargason, III | |
| 7,566,095 | B2 | 7/2009 | Reeb et al. | |
| 7,568,307 | B1 | 8/2009 | Zimhoni et al. | |
| 7,637,276 | B2 | 12/2009 | Mallookis et al. | |
| D612,624 | S | 3/2010 | Lovley et al. | |
| 7,673,643 | B2 | 3/2010 | Seo | |
| 7,703,469 | B2 | 4/2010 | Danzinger | |
| 7,735,504 | B2 | 6/2010 | Carter | |
| 7,753,063 | B1 | 7/2010 | Laws | |
| 7,753,064 | B2 | 7/2010 | Sy-Facunda | |
| 7,757,916 | B1 | 7/2010 | Petrie et al. | |
| 7,775,229 | B2 | 8/2010 | Sy-Facunda | |
| 7,784,480 | B2 | 8/2010 | Sy-Facunda | |
| 7,789,099 | B2 | 9/2010 | Mallookis et al. | |
| D625,507 | S | 10/2010 | Quinn | |
| 7,806,381 | B2 | 10/2010 | Sisk Horne et al. | |
| 7,836,907 | B2 | 11/2010 | Carter | |
| 7,849,867 | B2 | 12/2010 | Takayama | |
| 7,874,303 | B2 | 1/2011 | Xie | |
| 7,921,864 | B2 | 4/2011 | Carter | |
| 7,922,416 | B2 | 4/2011 | Davis et al. | |
| 7,954,272 | B2 | 6/2011 | Potterfield et al. | |
| 7,967,259 | B2 | 6/2011 | Nakatani | |
| 7,975,712 | B2 | 7/2011 | Beacco | |
| 7,980,519 | B2 | 7/2011 | Chen | |
| 7,997,291 | B2 | 8/2011 | Gressette et al. | |
| 8,006,711 | B2 | 8/2011 | Pietrzak et al. | |
| 8,025,455 | B2 | 9/2011 | Huang et al. | |
| D648,148 | S | 11/2011 | Henry | |
| 8,074,669 | B2 | 12/2011 | Collins et al. | |
| 8,075,217 | B2 | 12/2011 | Eason | |
| 8,079,380 | B2 | 12/2011 | Engstrom et al. | |
| 8,091,962 | B2 | 1/2012 | Quinn | |
| 8,128,306 | B2 | 3/2012 | Gorza | |
| 8,162,280 | B2 | 4/2012 | Yu et al. | |
| 8,185,979 | B2 | 5/2012 | Hentschel | |
| 8,186,755 | B2 * | 5/2012 | Lovley | A47C 7/66 135/119 |
| 8,191,744 | B2 | 6/2012 | Petrie et al. | |
| 8,220,477 | B2 | 7/2012 | Park | |
| 8,376,646 | B2 | 2/2013 | Melino et al. | |
| 8,408,225 | B2 | 4/2013 | Mallookis et al. | |
| 8,418,711 | B2 * | 4/2013 | Park | E04H 15/50 135/145 |
| 8,454,093 | B2 | 6/2013 | Smith | |
| 8,464,379 | B1 | 6/2013 | Zajac | |
| 8,590,553 | B2 | 11/2013 | Lovley et al. | |
| 8,608,118 | B2 | 12/2013 | Lai | |
| 8,616,226 | B2 * | 12/2013 | Ma | E04H 15/50 135/117 |
| 8,746,267 | B2 | 6/2014 | Lovley, II et al. | |
| 8,776,810 | B2 | 7/2014 | Lah et al. | |
| D712,730 | S | 9/2014 | Gridley | |
| 9,033,410 | B2 | 5/2015 | Roani | |
| 9,072,290 | B1 | 7/2015 | McCauley | |
| D736,884 | S | 8/2015 | Lovley, II et al. | |
| D737,066 | S | 8/2015 | Lovley, II et al. | |
| 9,101,222 | B2 | 8/2015 | Minkoff | |
| 9,103,138 | B2 | 8/2015 | Lovley, II | |
| 9,175,496 | B2 | 11/2015 | Darquea | |
| 9,220,347 | B2 | 12/2015 | Lovley, II et al. | |
| 9,279,269 | B2 | 3/2016 | Lovley, II et al. | |
| D774,815 | S | 12/2016 | Lovley, II et al. | |
| 9,528,292 | B1 | 12/2016 | Lovley, II et al. | |
| 2002/0030146 | A1 | 3/2002 | Akaike | |
| 2002/0112752 | A1 | 8/2002 | Blakney | |
| 2003/0090904 | A1 | 5/2003 | Ching | |
| 2003/0127822 | A1 | 7/2003 | Fleck et al. | |
| 2003/0164185 | A1 | 9/2003 | Price | |
| 2004/0084074 | A1 | 5/2004 | Chiu et al. | |
| 2004/0101351 | A1 | 5/2004 | Pitcher | |
| 2004/0178665 | A1 | 9/2004 | May | |
| 2004/0182430 | A1 | 9/2004 | Seo | |
| 2004/0222678 | A1 | 11/2004 | Hansen | |
| 2004/0238021 | A1 | 12/2004 | Holub et al. | |
| 2004/0255997 | A1 | 12/2004 | Seo | |
| 2004/0261828 | A1 | 12/2004 | Jang | |
| 2005/0028856 | A1 | 2/2005 | Seo | |
| 2005/0081904 | A1 | 4/2005 | Suzuki et al. | |
| 2005/0155637 | A1 | 7/2005 | Kim | |
| 2005/0178419 | A1 | 8/2005 | Tseng | |
| 2005/0178422 | A1 | 8/2005 | Wu | |
| 2005/0194030 | A1 | 9/2005 | Goldwitz | |
| 2005/0205124 | A1 | 9/2005 | Goldwitz | |
| 2005/0249545 | A1 | 11/2005 | Tsai | |
| 2006/0051159 | A1 | 3/2006 | Tsai | |
| 2006/0054207 | A1 | 3/2006 | Wootliff | |
| 2006/0062632 | A1 | 3/2006 | Jang | |
| 2006/0096631 | A1 | 5/2006 | Mallookis | |
| 2006/0144434 | A1 | 7/2006 | Chen | |
| 2006/0169311 | A1 | 8/2006 | Hwang | |
| 2006/0174929 | A1 | 8/2006 | Tseng | |
| 2006/0249192 | A1 | 11/2006 | Tsai et al. | |
| 2006/0260666 | A1 | 11/2006 | Choi | |
| 2007/0012346 | A1 | 1/2007 | Choi | |
| 2007/0018486 | A1 | 1/2007 | Ayers et al. | |
| 2007/0040422 | A1 | 2/2007 | Reeb et al. | |
| 2007/0051397 | A1 | 3/2007 | Choi | |
| 2007/0145792 | A1 | 6/2007 | Miller | |
| 2007/0181172 | A1 | 8/2007 | Harrison | |
| 2007/0204897 | A1 | 9/2007 | Habib et al. | |
| 2007/0221263 | A1 | 9/2007 | Tai | |
| 2007/0236058 | A1 | 10/2007 | Yeider | |
| 2007/0240748 | A1 | 10/2007 | Bae | |
| 2008/0035194 | A1 | 2/2008 | Goldwitz | |
| 2008/0087313 | A1 | 4/2008 | Jang | |
| 2008/0121260 | A1 | 5/2008 | Stephens et al. | |
| 2009/0071521 | A1 | 3/2009 | Sy-Facunda | |
| 2009/0087251 | A1 | 4/2009 | Chen | |
| 2009/0218856 | A1 | 9/2009 | Sykes et al. | |
| 2009/0309394 | A1 | 12/2009 | Chen | |
| 2010/0064739 | A1 | 3/2010 | Lu | |
| 2010/0101617 | A1 | 4/2010 | Stehly | |
| 2010/0102600 | A1 | 4/2010 | Lovley, II | |
| 2010/0269877 | A1 | 10/2010 | Sy-Facunda | |
| 2010/0275962 | A1 | 11/2010 | Park et al. | |
| 2011/0023924 | A1 | 2/2011 | Park | |
| 2011/0023925 | A1 | 2/2011 | Johnson et al. | |
| 2011/0073148 | A1 | 3/2011 | Choi | |
| 2011/0181078 | A1 | 7/2011 | Kelly | |
| 2011/0192436 | A1 | 8/2011 | Gridley | |
| 2011/0240078 | A1 | 10/2011 | Lenhart et al. | |
| 2011/0259381 | A1 | 10/2011 | Adams | |
| 2011/0274481 | A1 | 11/2011 | Chen | |
| 2011/0284045 | A1 | 11/2011 | Reeb | |
| 2011/0308559 | A1 | 12/2011 | Ma et al. | |
| 2012/0006373 | A1 | 1/2012 | Stehly | |
| 2012/0034023 | A1 | 2/2012 | Wang et al. | |
| 2012/0107037 | A1 | 5/2012 | Huang | |
| 2012/0146354 | A1 | 6/2012 | Lofley, Sr. et al. | |
| 2012/0175917 | A1 | 7/2012 | Chen | |
| 2012/0305042 | A1 | 12/2012 | Lorbiecki | |
| 2013/0069400 | A1 | 3/2013 | Nikolic | |
| 2013/0247948 | A1 | 9/2013 | Lovley, II et al. | |
| 2013/0284225 | A1 | 10/2013 | Holland et al. | |
| 2014/0021749 | A1 | 1/2014 | Roani | |
| 2014/0090682 | A1 | 4/2014 | Lovley, II | |
| 2014/0158176 | A1 | 6/2014 | Lovley, II | |
| 2014/0174491 | A1 | 6/2014 | Yang | |
| 2014/0190541 | A1 | 7/2014 | Lovley, II et al. | |
| 2014/0203619 | A1 | 7/2014 | Dapra | |
| 2014/0283891 | A1 | 9/2014 | Lovley, II et al. | |
| 2014/0306494 | A1 | 10/2014 | Frankel et al. | |
| 2015/0252587 | A1 | 9/2015 | Lovley, II | |
| 2015/0345172 | A1 | 12/2015 | Lovley, II | |
| 2016/0166062 | A1 | 6/2016 | Lovley, II | |

FOREIGN PATENT DOCUMENTS

| | | |
|---|---|---|
| CN | 1104546 | 4/2003 |
| CN | 2705649 | 6/2005 |
| CN | 2880991 | 3/2007 |

(56) References Cited

FOREIGN PATENT DOCUMENTS

| | | | |
|---|---|---|---|
| CN | 201216348 | Y | 4/2009 |
| CN | 102022609 | A | 4/2011 |
| CN | 202055611 | | 11/2011 |
| CN | 202706662 | U | 1/2013 |
| CN | 2545298 | | 4/2013 |
| DE | 26 55 028 | A1 | 6/1978 |
| DE | 31 31 166 | A1 | 2/1983 |
| DE | 35 360 49 | A1 | 4/1987 |
| DE | 42 01 743 | A1 | 10/1992 |
| DE | 102010049941 | | 5/2012 |
| EP | 564326 | | 10/1993 |
| FR | 532496 | | 2/1922 |
| FR | 2 691 619 | | 12/1993 |
| FR | 2805559 | | 8/2001 |
| GB | 2 052 960 | A | 2/1981 |
| GB | 2 091 648 | | 8/1982 |
| GB | 2 216 850 | | 10/1989 |
| JP | 58-129855 | | 9/1983 |
| JP | 61-7351 | | 1/1986 |
| JP | 7 207 962 | | 8/1995 |
| JP | 3059720 | | 7/2000 |
| JP | 2001-003604 | | 1/2001 |
| JP | 2001-254535 | | 9/2001 |
| JP | 2002-209663 | | 7/2002 |
| JP | 2005-290837 | | 10/2005 |
| JP | 2011-144606 | | 7/2011 |
| KR | 10-2002-0048191 | | 6/2002 |
| KR | 10-2004-0023115 | | 3/2004 |
| KR | 20060001341 | | 1/2006 |
| KR | 100886118 | | 2/2009 |
| KR | 20110054253 | | 5/2011 |
| KR | 10-2014-0135004 | | 11/2014 |
| SU | 1174551 | | 8/1985 |
| WO | WO 82/01984 | | 6/1982 |
| WO | WO 91/14386 | | 10/1991 |
| WO | WO 94/23162 | | 10/1994 |
| WO | WO 96/39066 | | 12/1996 |
| WO | WO 2005/024158 | | 3/2005 |
| WO | WO 2007/018926 | | 2/2007 |

* cited by examiner

CANOPY WITH DETACHABLE AWNING

INCORPORATION BY REFERENCE TO ANY PRIORITY APPLICATIONS

Any and all applications for which a foreign or domestic priority claim is identified in the Application Data Sheet as filed with the present application are hereby incorporated by reference herein and made a part of the present disclosure.

BACKGROUND

Field

The embodiments relate to a tent, canopy or other structure and, specifically, to a removable awning arrangement for such a tent, canopy or other structure.

Description of the Related Art

Tents or canopies, such as collapsible canopies, are often used in to provide shade or rain protection outdoors. In existing canopies, a small amount of height adjustment of the roof of the tent structure is provided by height adjustment of the support legs. Users can adjust the individual support legs to different heights to achieve an angled position of the roof of the tent structure to address sun, wind or rain that is directed at an angle and not sufficiently blocked by a horizontal orientation of the roof structure. However, such adjustment is typically quite limited and results in reduced overhead clearance within at least portions of the interior of the canopy. In addition, the tent roof size remains fixed.

SUMMARY

The systems, methods and devices described herein have innovative aspects, no single one of which is indispensable or solely responsible for their desirable attributes. Without limiting the scope of the claims, some of the advantageous features will now be summarized.

One or more embodiments provide a flexible adjustment of shade or rain protection, referred to herein as coverage. To address this purpose, the canopy includes a detachable awning and, in particular, detachable awning support structures. The canopy generally includes a roof and several support legs. The canopy also includes a removable awning structure, which includes removable awning connectors, tubes and awning cloth or other material. The awning connectors are connected to respective tube members and the awning connectors are detachably connectable to respective support legs of the canopy.

An embodiment involves a canopy having a detachable awning structure, said canopy comprises a roof and legs, characterized in that the canopy further comprises a detachable awning structure, said detachable awning structure comprising an awning-connecting member, an awning tube and an awning cloth or other suitable body, wherein said awning cloth is fixed on said awning tube, said awning tube being connected with said awning-connecting member, and said awning-connecting member being detachably connected to said leg.

In some configurations, said awning-connecting member comprises a leg groove and an awning tube groove; after being assembled, said awning tube being fitted to said awning tube groove and said leg groove being fitted tightly to said leg, so that said detachable awning structure is fixed to said leg. Said awning tube can be connected to said awning-connecting member by a rotating pin inserted into a fixing hole on said awning tube groove, and said awning tube being able to be rotated about the axis of said fixing hole relative to said awning-connecting member. A retention surface and a sloped entry surface can be provided at the upper portion of said awning tube groove of the awning-connecting member, said sloped entry surface helping said awning tube to slide downwards into said awning tube groove and said retention surface inhibiting or preventing the awning tube within the awning tube groove from moving out of said awning tube groove, so that said awning tube is retained in the awning tube groove in response to normal or expected forces. The cross sectional dimensions of the part of said leg groove that contacts said leg can be smaller than the cross sectional dimensions of said leg, so that said awning-connecting member is able to tightly clamp said leg without sliding downwards in response to normal or expected forces.

In some configurations, said awning tube is fixedly connected to said awning tube groove of the awning-connecting member by a fixing pin that is inserted into a fixing hole on the awning tube groove. Said awning-connecting member can be provided with an upper frame and a lower frame with flexibility that define said leg groove, and when installing, said frames being pulled open to make said awning-connecting member clamp on said leg, thus said awning-connecting member will be stably fixed on said leg due to flexibility of said frames. A tube plug can be provided at the end of said awning tube installed in the awning tube groove of the awning-connecting member, wherein a spring and a button are provided between said tube plug and bottom of said awning tube groove, a button hole being provided at the bottom of the awning tube groove, the wall of the leg that is installed in the leg groove pressing said spring and abut against said button, so that the wall of said leg tightly contacts with said frames ensuring that said awning-connecting member is fixed at a specific height of the leg without slipping off.

In some configurations, said awning-connecting member is made of elastic or resilient material.

In some configurations, said detachable awning structure(s) is(are) installed at any one or more sides of said canopy.

In some configurations, one or two sides of said canopy each is provided with two detachable awning structures, wherein the two detachable awning structures are fixedly installed at different heights of said legs.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1A:
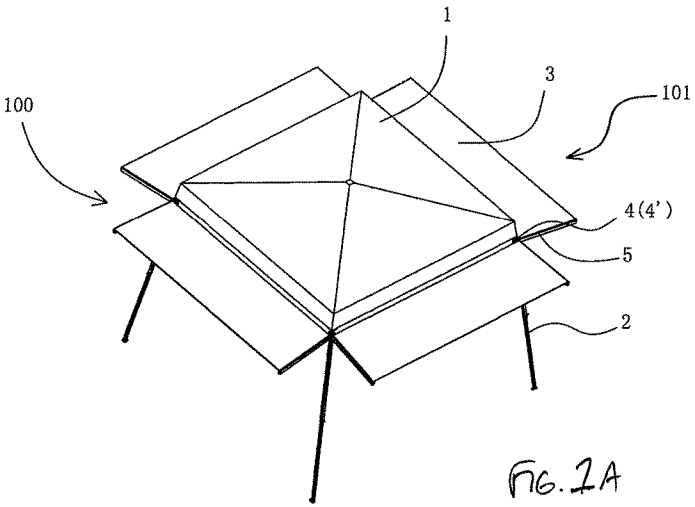
FIG. 1A is a top perspective view of a canopy equipped with four detachable awning structures having certain features, aspects and advantages of an embodiment.
Figure 1B:
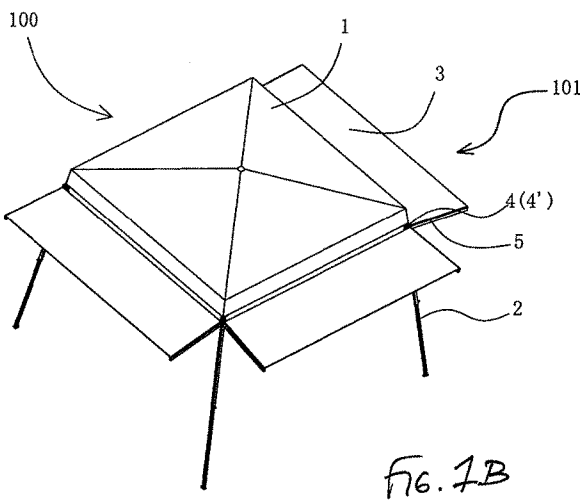
FIG. 1B is a top perspective view of the canopy with three detachable awning structures.
Figure 1C:
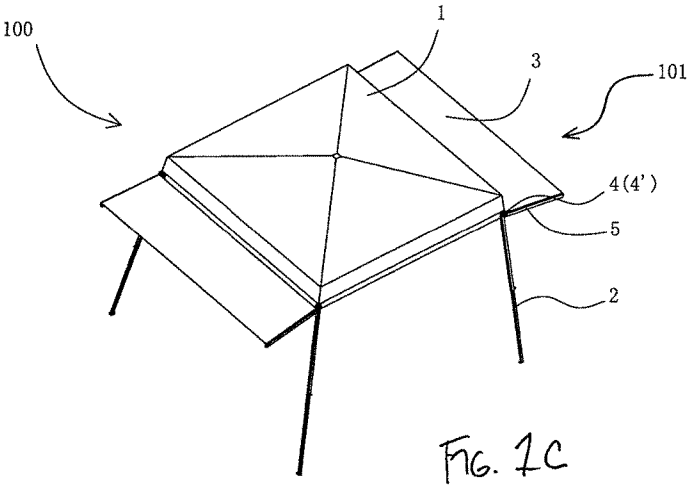
FIG. 1C is a top perspective view of the canopy with two detachable awning structures positioned on opposite sides of the canopy.
Figure 1D:
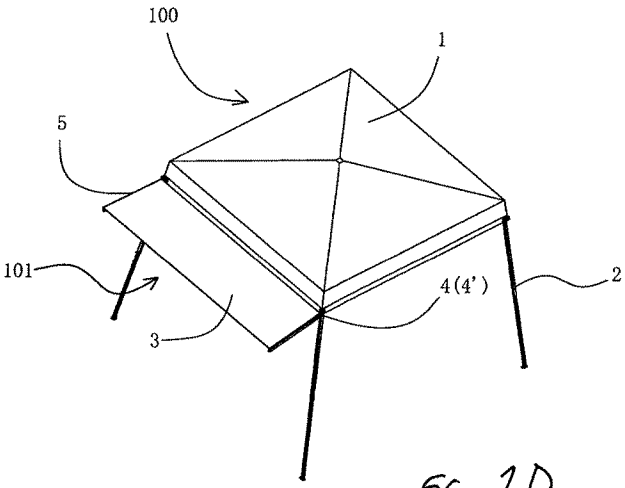
FIG. 1D is a top perspective view of the canopy with one detachable awning structure on one side of the canopy.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

FIGS. 1A-1D illustrate perspective views of a tent or canopy 100, which can be a collapsible canopy, incorporating one or more detachable awning arrangements, each of which can be referred to herein as an overhang 101. As shown, the tent 100 includes a roof 1, one or more support legs or pipes 2 (which may be height adjustable—e.g., telescoping) and one or more detachable awnings or overhangs 101. The detachable awnings or overhangs 101 disclosed herein are detachable without the use of tools. Preferably, the awnings or overhangs 101 can be quickly and conveniently assembled to the associated tent 100 without the use of tools. In the illustrated configurations, the resiliency of the couplings or connection members produces at least a portion of a retention force for the detachable awnings or overhangs 101. Additional coupling members or arrangements can provide additional retention force. The tent 100 can be a collapsible or folding canopy having a foldable frame and a cover, such as those sold under the trademark EZ-UP. One example of a collapsible canopy is disclosed in U.S. Pat. No. 5,634,483, the entirety of which is incorporated by reference herein. The awning arrangement 101 generally comprises one or more awning supports, such as a pair of awning support tubes 5, awning fabric or an awning body 3 of another material and detachable connections 4, 4' coupled to respective awning support tubes 5. When assembled, the detachable connections 4, 4' are mounted on respective support legs 2 of the canopy 100 and support the awning support tubes 5 relative to the canopy support legs 2, thereby permitting quick and removable installation of the overhang 101 on the canopy 100. The awning body 3 can be permanently coupled to the awning support tubes 5 or, in some configurations, the awning body 3 can be positioned on the awning support tubes 5 (e.g., slid onto) after the awning support tubes 5 are attached to the canopy support legs 2. FIGS. 1A-1D shows only four possible mounting arrangements of the overhang structure scheme. In fact, the overhang structure 101 may be mounted on any side of the tent 100 and at any height based on the actual needs in order to achieve desired side shade or side rain protection, for example.

Figure 2:
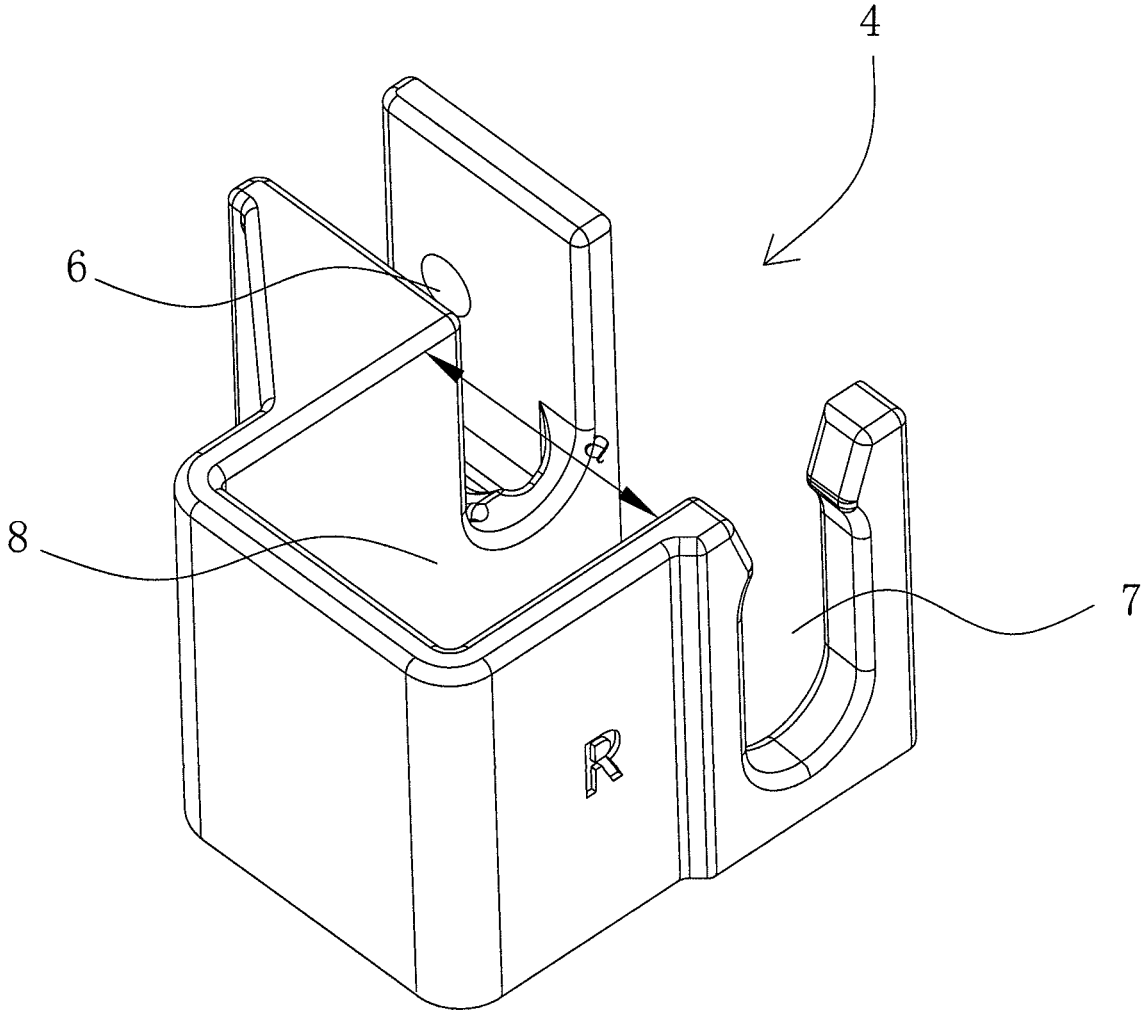
FIG. 2 is a perspective view of a first embodiment of a connecting member for detachably connecting an awning support member to a support leg of the canopy.

FIG. 2 is a perspective view of a first embodiment of the connecting member 4 separate from the canopy 100. As shown, the awning connector 4 includes a leg opening 8 that removably and securably receives a support leg 2 of the canopy 100. The awning connector 4 also includes an awning support tube opening or groove 7 that selectively receives the awning support tube 5. At least one or a pair of fixing holes 6 rotatably supports the awning support tube 5, such as via a shaft, pin or fastener. Rotation of the awning support tube 5 about the rotation pin (not shown) or other support member inserted into the holes 6 allows the awning 101 to be assembled to the support leg 2 of the canopy and selectively secured in place. In some configurations, the awning 101 can be moved between two positions, such as a raised and lowered position, for example.

Figure 3:
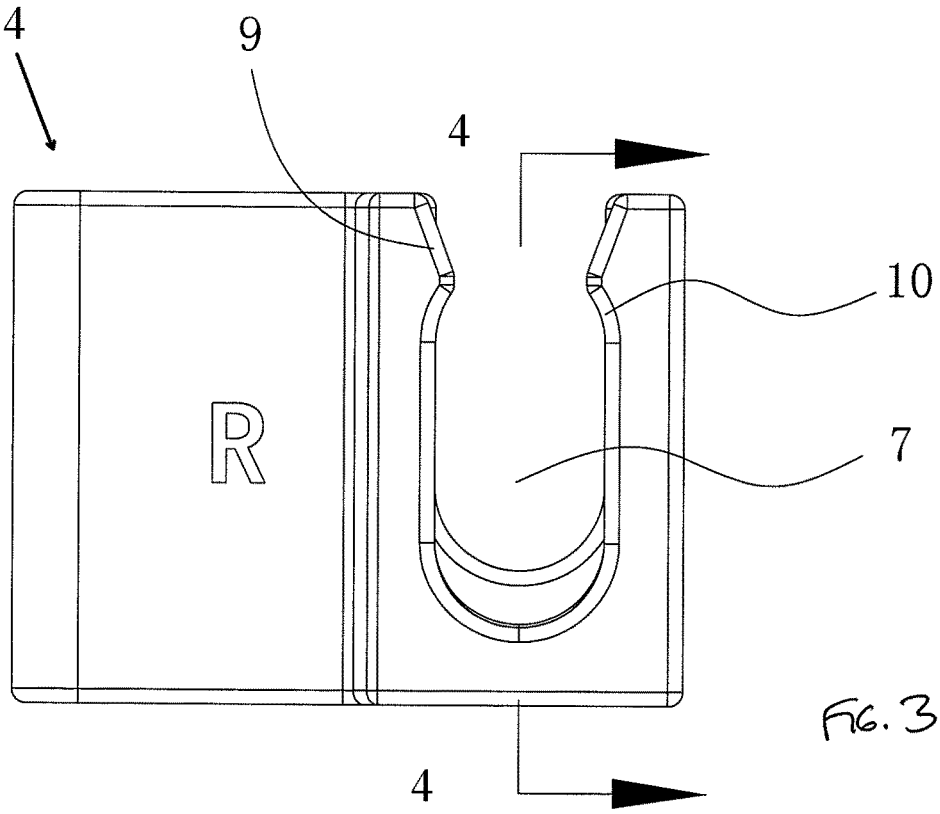
FIG. 3 is a front view of the connecting member of FIG. 2.
Figure 4:
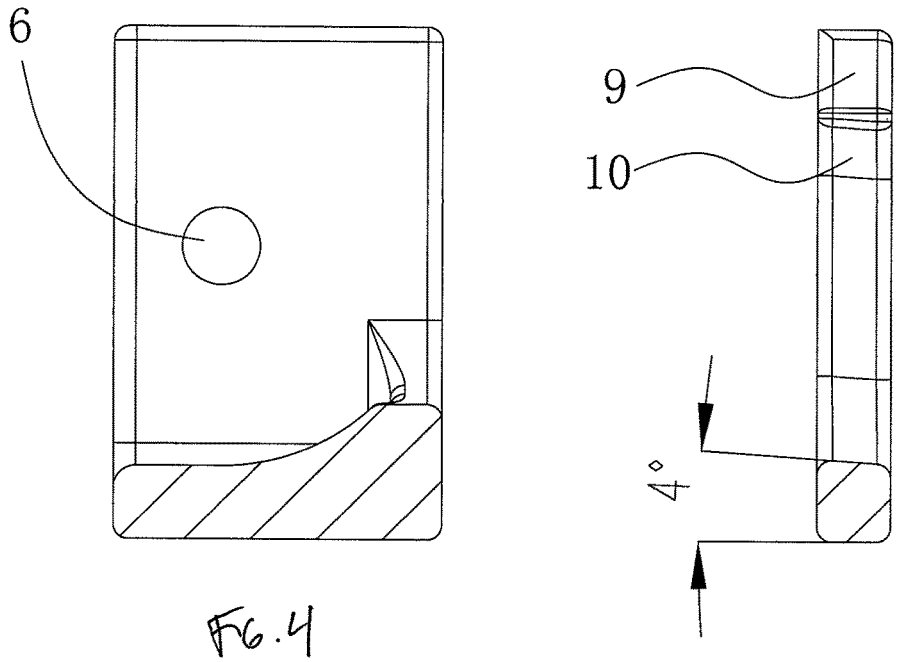
FIG. 4 is a sectional view of the connecting member of FIG. 2 taken along line 4-4 in FIG. 3.

FIG. 3 is a front view of the overhang connector member 4 and FIG. 4 is a cross-sectional view taken along line 4-4 in FIG. 3. The connecting member 4 preferably has retention surface 10 at an open or upper end of the groove 7 to inhibit unintentional or undesirable removal of the awning support tube 5 from the groove 7. The entry or mouth of the groove preferably defines a sloped entry surface 9, which facilitates entry of the awning support tube 5 into the groove 7. The bottom surface of the groove 7 is angled or offset from the horizontal plane (or a plane perpendicular to an axis of the leg opening 8) by an angle such that when the awning support tube 5 is installed, the awning 101 is inclined towards the ground in a direction away from the outer edge of the roof 1. Preferably, the angle is between about 2-15°, about 2-10° or about 4°. If desired, the bottom surface of the groove 7 can be arranged in the horizontal plane (or the plane perpendicular to an axis of the leg opening 8), and thus the tube 5 and the awning 101 when installed can be parallel to the ground.

In one or more configurations, during the installation of the overhang 101 to the tent structure 100, each side of the cloth or other overhang body 3 is fixed to an awning tube 5. The connecting members 4 are connected to the support legs 2 of the tent 100 by inserting the leg 2 into the leg opening 8. Then, the awning support tube 5 is rotated into the groove 7 through the entry surface 9 of the mouth and is retained in place by the retention surface 10. In such a position, the awning support tube 5 preferably contacts the leg tube 2 and tightly jams the leg tube 2 in the opening 8 and against the connecting member 4 so that the overhang tube 5 is fixedly coupled to the tent leg tube 2. In some configurations, the overhang tubes 5 are connected to the leg tubes 2 and then the awning member 3 is assembled to the two adjacent tubes 5 so that the overhanging awning cloth or body 3 is attached the outer edge of the roof 1 in order to achieve a good supplement shading or rain protection.

Preferably, to facilitate the awning connection member 4 being fixedly connectable to the tent leg tube 2, a material having elasticity is utilized in constructing the awning connecting member 4 such that the groove 8 can have a relaxed or normal size that is slightly smaller than the cross section of leg tube 2. That is, in at least some configurations, the leg opening dimension (a) of the groove 8 is slightly smaller than the width of a leg tube 2 corresponding to the width (a) of the opening so that the awning has a resilient member 4 that can snap tightly to the leg tube 2 and be removably connected thereto without slipping on leg tube 2 in response to normal or expected forces. The resilient or elastic material can also enhance frictional engagement with the leg tube 2. Other suitable structural features can be employed that permit the overhang 101 leg connecting member 4 to be detachably, semi-permanently or permanently connected to the leg tube 2.

Figure 5:
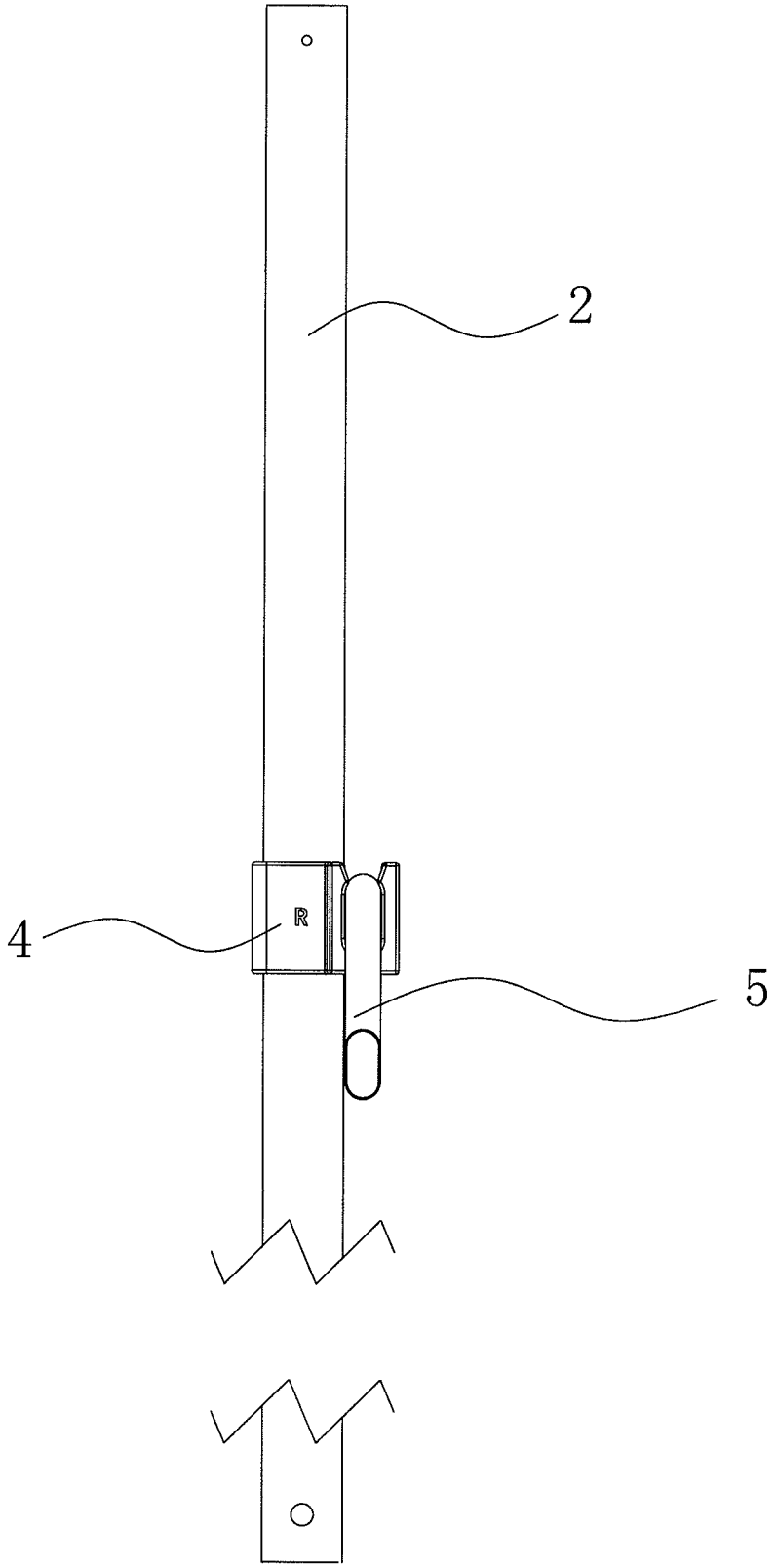
FIG. 5 is a front view of an assembly of the connecting member detachably coupling an awning support tube to a canopy support leg.
Figure 6:
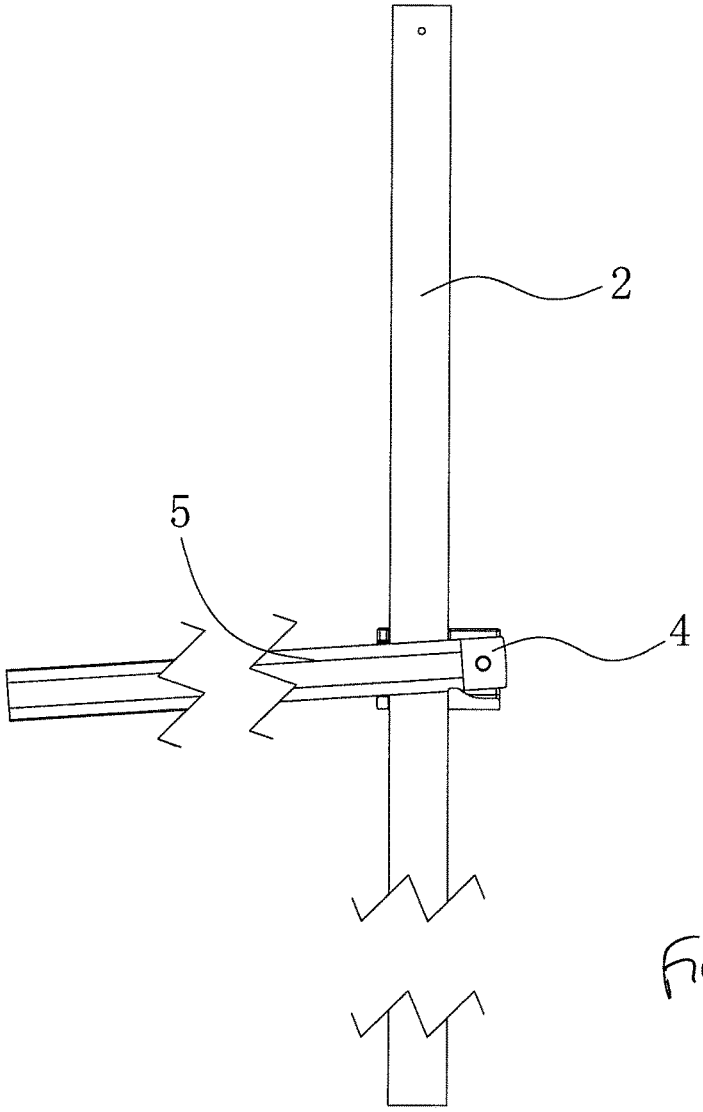
FIG. 6 is a side view of the assembly of FIG. 5.
Figure 7:
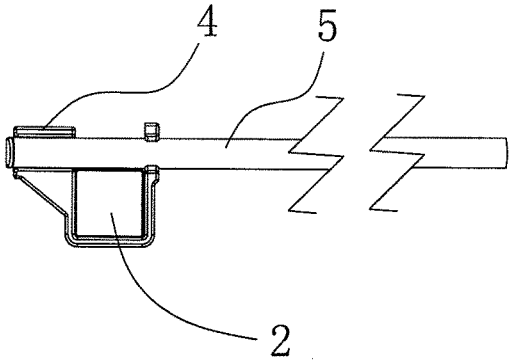
FIG. 7 is a top view of the assembly of FIG. 5.

FIG. 5 is an assembly including the awning connecting member 4 shown in FIGS. 2-4 coupled to a tent support leg 2 and supporting an awning support tube 5. FIG. 6 is a side view of the assembly of FIG. 5. FIG. 7 is a top view of the assembly of FIG. 5. In the illustrated assembly, the awning support tube 5 is securely connected to the tent support leg 2 (e.g., such that it does not move on the leg 2 in response to normal or expected operational forces) and is slightly inclined in a downward direction from the inner to the outer edge of the awning 101. To remove the awning 101, the awning support tube 5 can be simply rotated upwards and moved out of registration with the leg opening 8 such that the connecting member 4 can be removed from the tent support leg 2. In the illustrated arrangement, the connecting member 4 is positioned on or surrounds three sides and the awning support tube 5 is positioned on or surrounds the fourth side.

Figure 8:
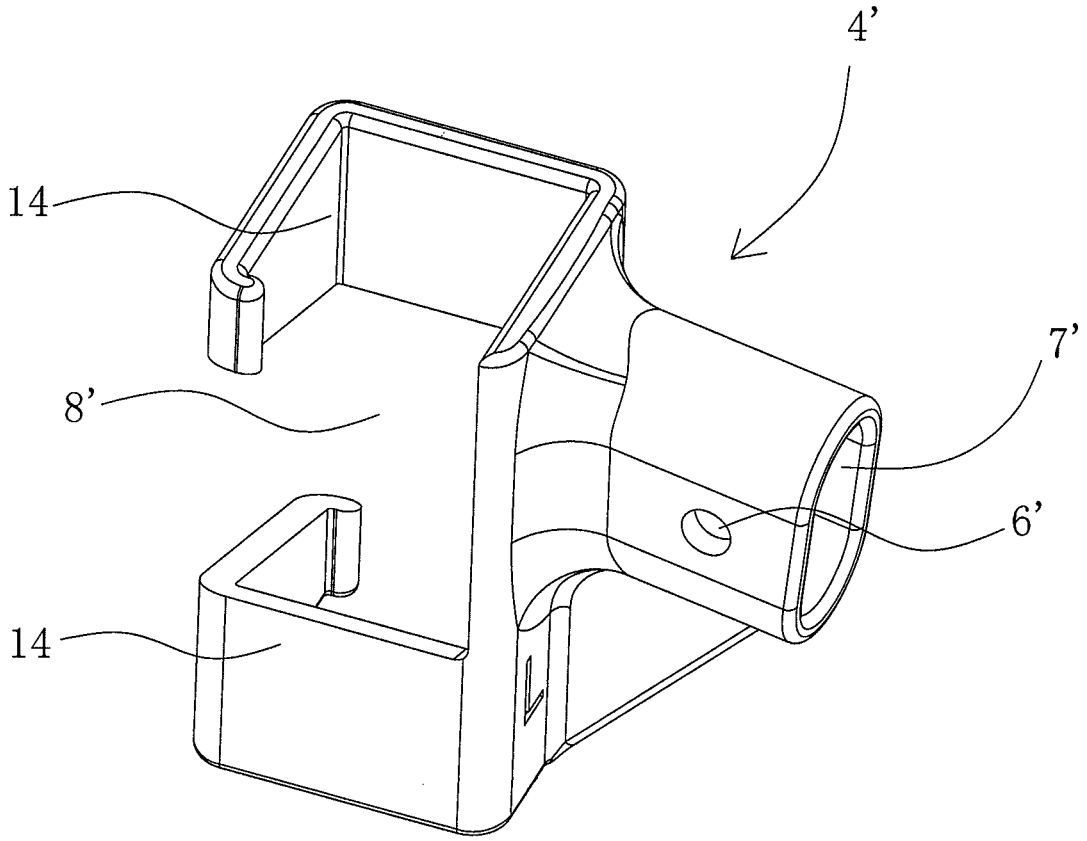
FIG. 8 is a perspective view a second embodiment of a connecting member for detachably connecting an awning support member to a support leg of a canopy.
Figure 9:
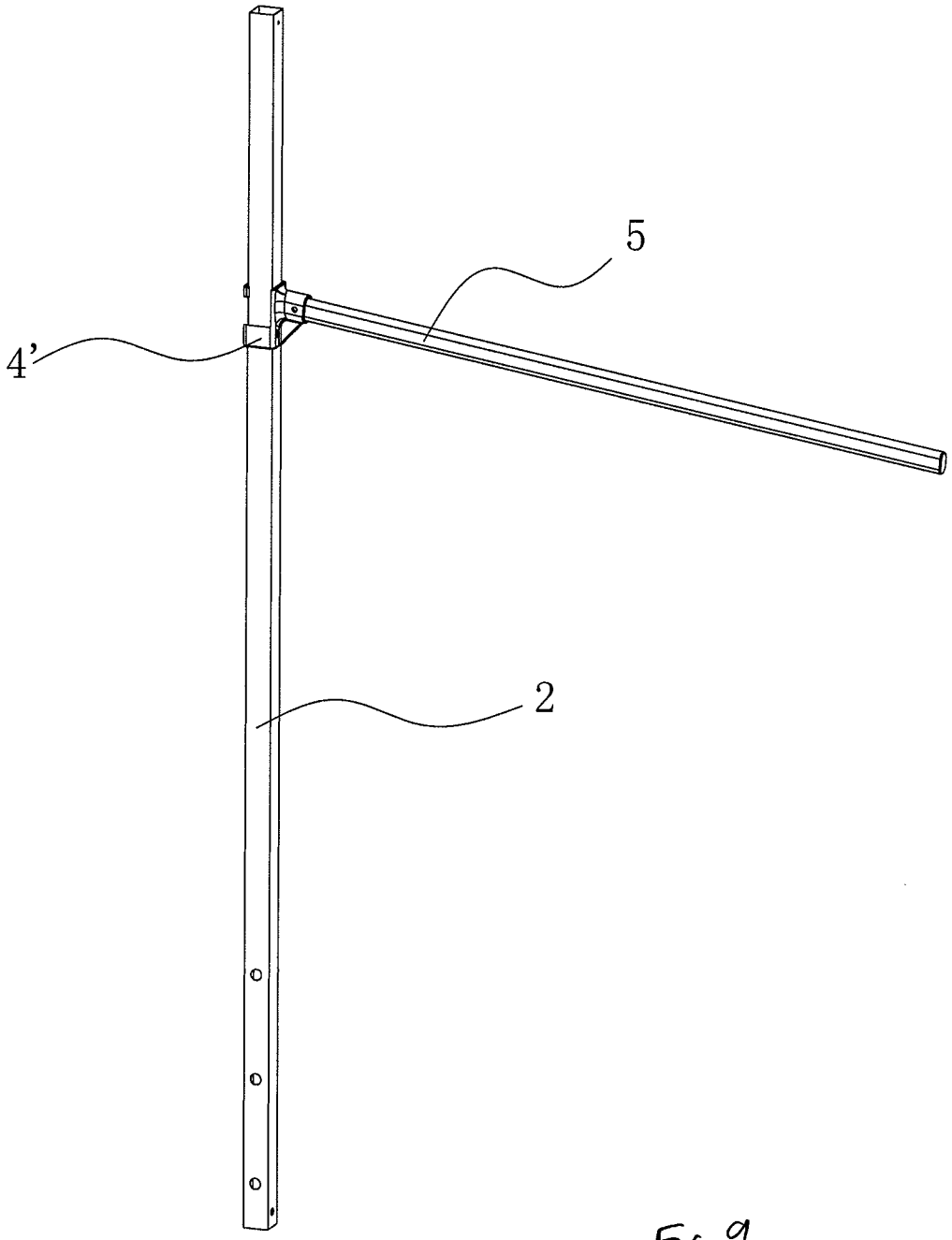
FIG. 9 is a perspective view of an assembly of the connecting member of FIG. 8 detachably coupling an awning support member to a support leg of a canopy.
Figure 10:
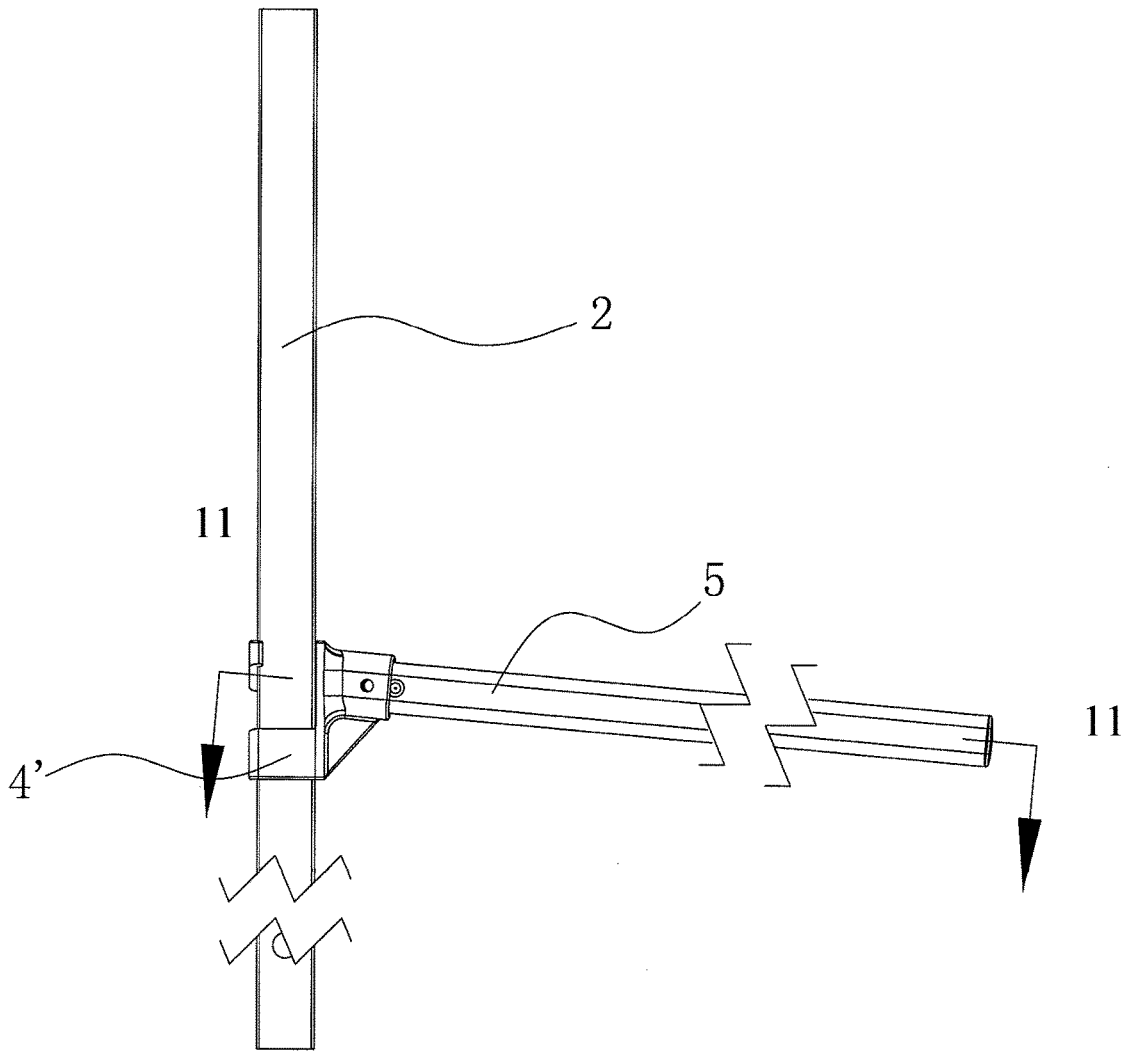
FIG. 10 is a side view of the assembly of FIG. 9.

FIG. 8 is a perspective view of a second embodiment of the connector 4', which is a modification of the connector 4 of FIGS. 2-7. Similar to the prior embodiment, the connector 4' includes a leg opening 8', awning support tube duct 7' and awning support tube fixing holes 6'. Preferably, the awning support tube 5 is received in the duct 7' and is attached to the connector 4' by a fixing pin (not shown) or other suitable fastener received within the tube fixing holes 6'. Preferably, the awning connecting member 4' is constructed of an at least somewhat elastic or resilient material, such as a relatively flexible plastic material, for example.

The awning connecting member 4' can be mounted to the leg tube 2 via upper and lower connection arms 14 that cooperate to receive and engage the leg tube 2. Preferably, the upper and lower connection arms 14 can deflect to permit engagement of the connecting member 4' with the tent leg tube 2 and then resiliently return toward a relaxed position and/or toward restoration of the original shape to engage the leg tube 2. In some configurations, a space between the arms 14 allows entry of the leg tube 2 into the leg opening 8' when the connecting member 4' is rotated to a particular angle and, once the leg tube 2 is located within the leg opening 8', the connecting member 4' can be rotated to cause the arms 14 to flex outwardly and then resiliently return to engage the leg tube 2. Each of the arms 14 can be located on or wrap a portion or all of three sides of the leg tube 2. Each of the arms 14 can include a hook end that engages the fourth side of the leg tube 2. Preferably, the hook end wraps only partially around the fourth side of the leg tube 2. In the illustrated arrangement, the arms 14 mirror each other such that the hook ends engage different (e.g., opposite) sides of the leg tube 2.

Figure 11:
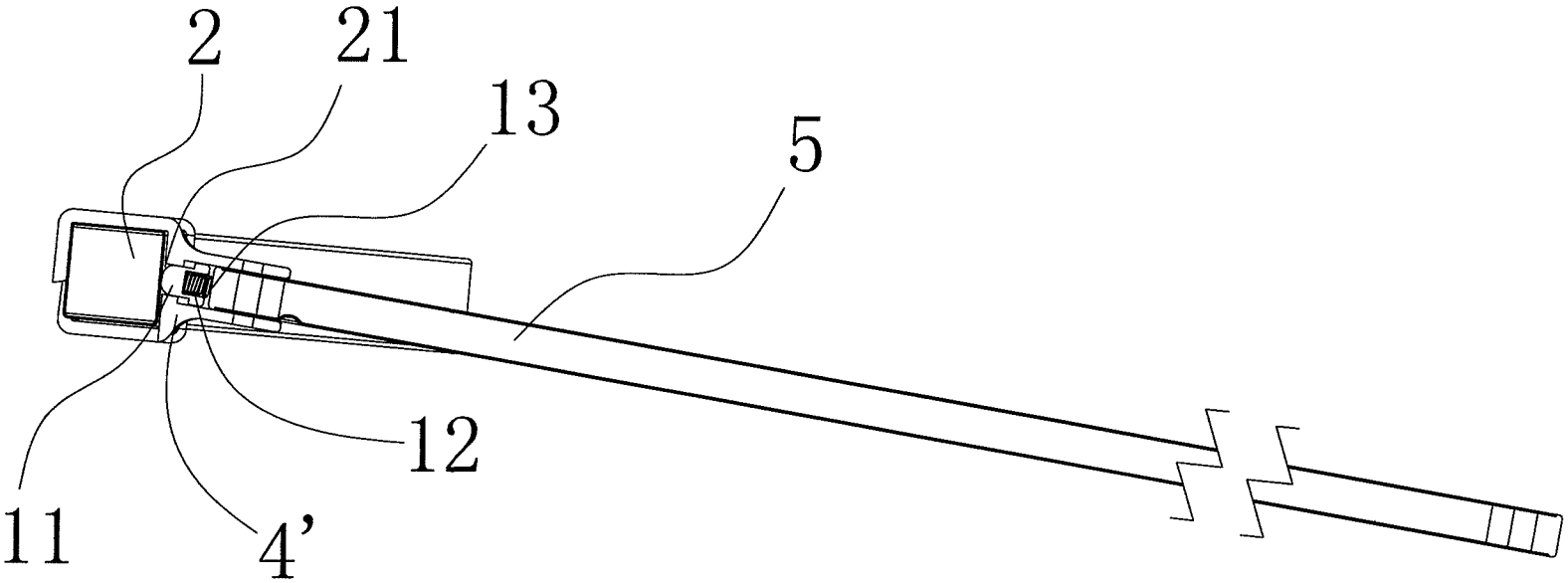
FIG. 11 is a cross-sectional view of the assembly of FIG. 9 taken along line 11-11 in FIG. 10.

With reference to FIG. 11, preferably the end of the awning support tube 5 includes an end surface, which can be defined by an end plug 13 or other suitable structure. In addition, preferably, the connector 4' includes a spring 12 acting between the end plug 13 and an engagement member 11, which can contact the leg tube 2 via the biasing force of the spring 12 to inhibit or further inhibit movement of the connecting member 4' relative to the leg tube 2. In some arrangements, the engagement member 11 can engage empty adjustment openings 21 of the leg tube 2. Accordingly, after installing the awning leg 5 to the leg tube structure 2, the compression spring 12 urges the engagement member 11 into the adjustment opening or hole 21 to squeeze the leg tube 2 thereby further ensuring that the awning connector 4' is fixed on the leg tube 2 at a specific height without slippage. The engagement member 11 could also be configured to frictionally engage the leg tube 2 and could comprise or be constructed of a rubber, rubber-like or other grip-enhancing material.

Figure 12:
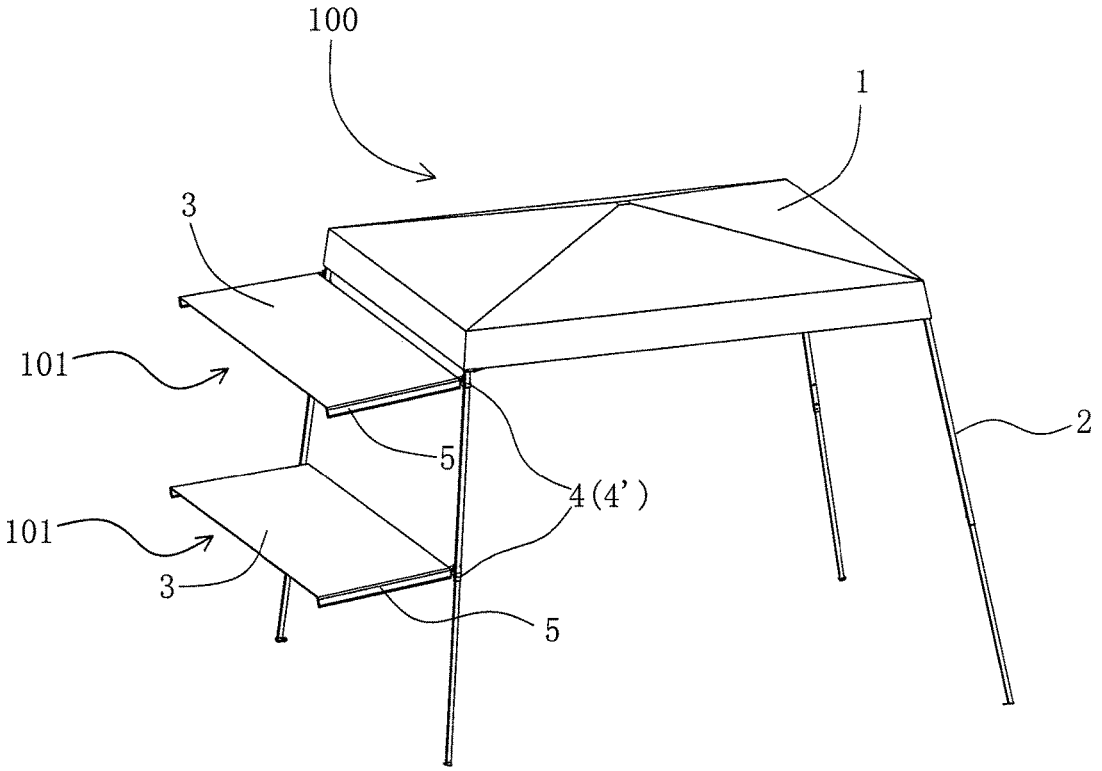
FIG. 12 is a perspective view of an arrangement in which one side of a canopy is provided with two overhangs or awning arrangements staggered in height from another.

FIG. 12 illustrates one awning 101 coupled to the tent 100 with connectors 4 (the upper awning 101) and a second awning 101 coupled to the tent 100 with the connectors 4' (the lower awning 101) engaging empty adjustment openings 21 of the leg tubes 2. The second awning 101 is positioned below the first awning 101. When the solar elevation angle is small, this installation method further provides better shading effect. For example, some smaller pets can avoid sunlight under the lower position of the awning.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A canopy comprising:

a roof;

a plurality of legs that support the roof at an elevated position from a surface upon which the canopy rests; and a detachable awning structure, said detachable awning structure comprising an awning-connecting member, an awning tube and an awning body, wherein said awning body is supported by said awning tube, wherein said awning tube is connected to one of said plurality of legs by said awning-connecting member, and wherein said awning-connecting member is detachable from said one leg;

wherein said awning-connecting member comprises a leg groove and an awning tube groove, wherein said awning tube is secured within said awning tube groove and said one leg is secured within said leg groove so that said detachable awning structure is fixed to said one leg;

wherein said awning tube is fixedly connected to said awning tube groove of the awning-connecting member by a fixing pin that is inserted into a fixing hole on the awning tube groove;

wherein said awning-connecting member is provided with an upper arm and a lower arm with flexibility that define said leg groove, and when installing, said arms being pulled open to make said awning-connecting member clamp on said leg, thus said awning-connecting member is connected to said leg and retained by a resilient force of said arms; and wherein a tube plug is provided at the end of said awning tube installed in the awning tube groove of the awning-connecting member, wherein a spring and a button are provided between said tube plug and bottom of said awning tube groove, a button hole being provided at the bottom of the awning tube groove, a wall of the leg installed in the leg groove being configured to press said spring and abut against said button, so that the wall of said leg tightly contacts with said arms to fix said awning-connecting member at a specific height of the leg.

2. The canopy of claim 1, wherein said awning-connecting member is made of an elastic or resilient material.

3. The canopy of claim 1, wherein a plurality of said detachable awning structures are installed on one or more sides of said canopy.

4. The canopy of claim 1, wherein one or two sides of said canopy each is provided with two detachable awning structures, wherein the two detachable awning structures are fixedly installed at different heights of said legs.

5. A canopy comprising:

a roof;

a plurality of legs that support the roof; and at least one detachable awning structure, the at least one detachable awning structure comprising at least one connecting member, at least one tube and an awning body, wherein the awning body is supported by the at least one tube;

wherein the at least one connecting member is configured to be removably secured to at least one of the plurality of legs;

wherein the at least one tube is configured to connect to the at least one connecting member;

wherein the at least one connecting member comprises a leg groove and a tube groove, wherein the at least one tube is configured to be secured within the tube groove, and wherein one of the legs is configured to be secured within the leg groove;

wherein the at least one connecting member comprises an upper connection arm and a lower connection arm, wherein the upper and lower connection arms are configured to deflect to permit engagement of the at least one connecting member with one of the legs, wherein the upper and lower connection arms are configured to resiliently return toward a relaxed position and toward restoration of an original shape of the at least one connecting member to engage one of the legs, wherein the at least one connecting member can be selectively positioned along and secured to any portion of the plurality of legs based solely on a resilient force created by the upper and lower connection arms; and wherein a retention surface and a sloped entry surface are provided at an upper portion of the tube groove of the at least one connecting member, the sloped entry surface being configured to facilitate positioning the at least one tube into the tube groove, wherein the retention surface being configured to prevent the at least one tube from moving out of the tube groove.

6. The canopy of claim 5, wherein the at least one tube is connected to the at least one connecting member by a rotating pin inserted into a fixing hole located along the tube groove, and wherein the at least one tube is rotatable about an axis of the fixing hole relative to the at least one connecting member.

7. The canopy of claim 5, wherein the leg groove is sized and configured so that the at least one connecting member tightly clamps around one of the legs without sliding downwardly in response to normal or expected forces.

8. The canopy of claim 5, wherein the at least one tube is coupled to the tube groove of the at least one connecting member using a pin.

9. The canopy of claim 5, wherein the at least one connecting member comprises an elastic or resilient material.

10. The canopy of claim 9, wherein the at least one connecting member comprises a flexible plastic.

11. The canopy of claim 5, wherein the at least one detachable awning structure comprises a plurality of detachable awning structures configured to be secured to one or more sides of the canopy.

* * * * *